United States Patent [19]

Nagy

[11] 4,085,504

[45] Apr. 25, 1978

[54] MULTI-BLADED KNIFE

[76] Inventor: Janos Nagy, 2600 Monroe St., Hollywood, Fla. 33020

[21] Appl. No.: 761,995

[22] Filed: Jan. 24, 1977

[51] Int. Cl.[2] ..... B26B 3/04

[52] U.S. Cl. ..... 30/123; 30/304

[58] Field of Search ..... 30/304, 305, 123, DIG. 1, 30/329; 279/41, 41 A, 87, 105

[56] References Cited

U.S. PATENT DOCUMENTS

| | | | |
|---|---|---|---|
| 639,850 | 12/1899 | Hahn | 30/304 |
| 1,342,383 | 6/1920 | Horvath | 30/304 |
| 3,831,276 | 8/1974 | Dalton | 30/123 |

*Primary Examiner*—Jimmy C. Peters
*Attorney, Agent, or Firm*—Robert D. Farkas

[57] ABSTRACT

This disclosure pertains to a handle, housing a battery and a switch and is adapted with a removable blade securing bar extending transverse to the longitudinal axis of the handle. A plurality of blades are removably engaged within a series of spaced apart notches in the bars. A lamp is secured to the handle providing a convenient work light covering the area that includes a series of blades extending parallel to the longitudinal axis of the handle when the blades are secured within the notches. Each blade is adapted with at least one cutting edge and may be secured to the bar with the cutting edge extending in a preferred location, thus enabling the user to select either of two types of cutting edges or to position a variety of cutting edges of the adjacent blades in a cutting work plane and to position the blades selectively in the notches, providing thereby a variety of cutting widths.

9 Claims, 6 Drawing Figures

MULTI-BLADED KNIFE

BACKGROUND OF THE INVENTION

1. The Field of the Invention

This invention pertains to multi-bladed manually operated knives and more particularly to that class including a portable light source affixed to the handle thereof.

2. Description of the Prior Art

The prior art abounds with multi-bladed slicing knives. U.S. Pat. No. 1,128,479 issued on Feb. 16, 1915 to P. McPherson teaches a multi-bladed slicer including a plurality of knife blades in fixed spaced apart relationship when secured to a blade retaining handlebar and extending parallel to the longitudinal axis of the handle. U.S. Pat. No. 726,697 issued on Apr. 28, 1903 to W. Kelley discloses a conventional single bladed knife whose handle is adapted to secure two additional knife blades thereto. The outermost pair of knife blades are removable thereby enabling the user to utilize the remaining single bladed knife in conventional fashion. U.S. Pat. No. 205,871 issued on Nov. 21, 1916 to J. T. Dwyer, reveals a triple bladed manually operated knife including a lead screw mechanism having oppositely threaded ends utilized to vary the spacing of the outermost pair of knives when the lead screw is manually rotated by the user, providing thereby a triple bladed knife whose blades are spaced varying distances apart so as to obtain slices of the work object in selected varying thicknessess.

All of the aforementioned patents suffer the common deficiency of utilizing blades that have only one cutting edge and providing a multi-bladed knife which lacks a portable work light enhancing the versatility of the assembled knife during use.

SUMMARY OF THE INVENTION

A primary object of the instant invention is to provide a multi-bladed knife equipped with a battery operated light source facilitating more accurate use of the knife as a cutting instrument.

Another object of the instant invention is to provide an apparatus facilitating the mounting of the blades so that either of the cutting edges thereof may be selectively employed when cutting.

Still another object of the instant invention is to provide a blade securing bar which enables the user to select amongst discreet locations mounting positions for a quantity of blades. Yet another object of the instant invention is to provide a knife apparatus which is quickly dis-assembled enabling the user to clean the blade portions and the blade securing bar without wetting or otherwise damaging the handle portion thereof.

Another object of the instant invention is to provide an apparatus which enables the user to conveniently dis-assemble component parts thereof facilitating a small compact package for storage when not in use.

The handle of the instant invention houses a battery power supply and includes a lamp whose light emitting portion is located at the end thereof, to which is threadingly secured a transverse blade securing bar. Notches within the bar are adapted with a blade securing groove utilized to engage projections on the proximal end of the blade, securing the blade within selected spaced apart notches and permitting the user to selectively position a plurality of blades within selected notches, such that the longitudinal axis of the blades employed extends parallel to the longitudinal axis of the handle and are illuminated by the lamp when a lamp operating switch is manually closed completing the circuit between the terminals of the lamp and the batteries housed within the handle. Blade edges may be deployed in a selected pattern enhancing the cutting flexibility and versatility of the assembled apparatus.

These objects as well as other objects of the present invention, will become readily apparent after reading the following description of the accompanying drawings.

DESCRIPTION OF THE PREFERRED EMBODIMENT

The structure and method of fabrication of the present invention is applicable to a hollow handle utilized as a housing for a pair of batteries arranged in a series electrical circuit providing a source of electrical energy to a lamp secured to the distal end of the handle. A switch is utilized to selectively energize or de-energize the lamp upon the manual manipulation thereof. A portion of the lamp, utilized to emit light, is permitted to extend outwardly from distal end of the handle which provides a working light for the apparatus when in use. A threaded rod is fixedly secured at the end of the handle adjacent the lamp and is utilized to threadingly engage a knife securing bar having the longitudinal axis thereof transverse to the handle, by engagement within a threaded hole centrally located in the proximal surface of the bar. A locking nut is installed on the threaded rod between the distal end of the handle and the adjacent face of the bar and is utilized to prevent undesired rotation of the bar about the longitudinal axis of the threaded rod.

A plurality of rectangularly shaped notches extend in spaced apart relationship along the length of the bar and have walls that are parallel to each other and parallel to the longitudinal axis of the handle when the bar is assembled thereto. The walls have grooves which are employed to grasp, in cam like fashion, a rivet extending outwardly from the lateral surfaces of the proximal end of each knife blade. A cover plate, whose length is substantially equal to the length of the bar is provided with a plurality of similarly shaped rectangular notches whose openings are co-terminus with the notch openings in the bar when the cover plate is slidingly engaged to the bar utilizing folded over ends of the cover plate to engage wing like projections located at each end of the bar therefor.

The convolutions of the grooves in the two walls of the bar located at each notch enables the user to invert selectively each blade as the blade is assembled to the bar. The notch prohibits disengagement of the blade, along the direction of the longitudinal axis of the blade, by engaging the outwardly projecting portions of the rivet, which is located along the mid line of the blade and extends outwardly from the opposing lateral surfaces at the proximal bar engaging portion thereof.

The cover plate is equipped with mating notches to the notches provided in the bar and when the notches are secured to the bar the blades are prevented from rotating about the protruding rivet head by grasping the proximal edge of the blade.

Figure 1:
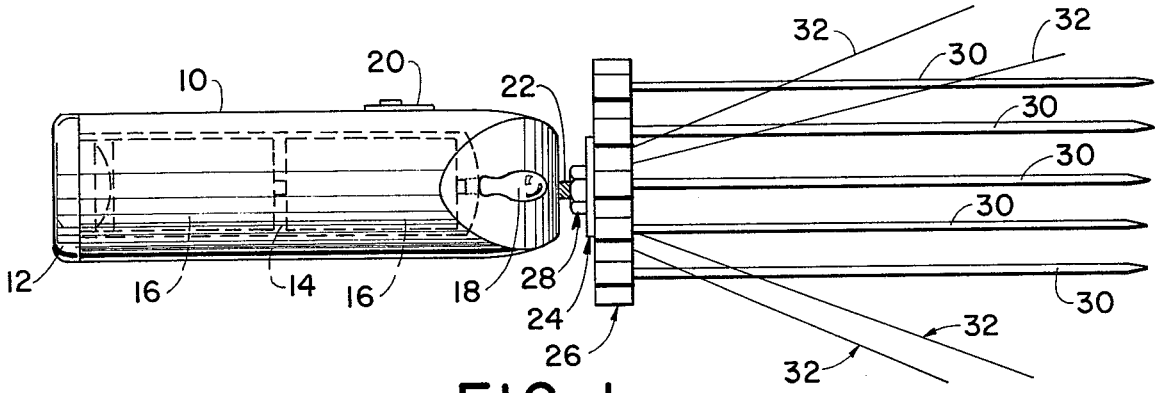
FIG. 1 is a plan view of the instant invention showing five blades attached to the handle.

Now referring to the Figures, and more particularly to the embodiment illustrated in FIG. 1 showing a handle 10 having a rearmost access plate 12 removably affixed thereto providing access to a cavity 14 located within the handle. Batteries 16 are connected in a series circuit, providing electrical power to lamp 18, affixed to the housing. Switch 20 is utilized to interrupt or connect the terminals of lamp 18 to the series circuit consisting of batteries 16. Threaded rod 22 is secured to the handle 10 and threadingly engages plate 24, which is affixed to the blade securing assembly 26. Nut 28 is utilized to jamb against the face of plate 24 adjacent the handle 10 and prevents rotation of assembly 26 thereby. Blades 30 extend outwardly from blade clamping assembly 26. Lamp 18 emits light beams 32 which cover the area occupied by parallel knife blades 30.

Figure 2:
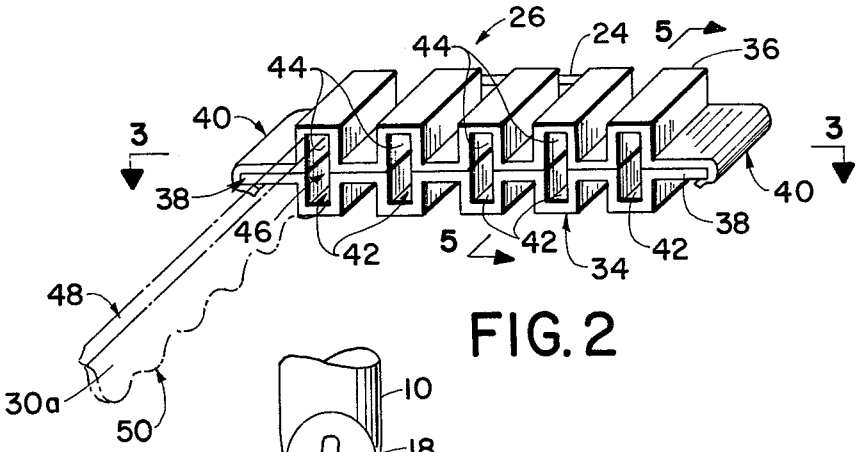
FIG. 2 illustrates the blade securing bar and cover plate shown in FIG. 1 and a portion of a single blade secured thereto shown in phantom lines.

FIG. 2 illustrates the knife capturing assembly 26, as shown in FIG. 1. Plate 24 is fixedly secured to bar element 34 at the proximal face thereof. Cover plate 36 slidingly engages to wings 38 of bar 34 utilizing the clamping frictional forces obtained by turned over edges 40 therefor. Rectangular notches 42, located in bar 34 have the openings thereof mate with the rectangular notches 44 located in cover plate 36. Knife blade **30*a* is illustrated in phantom extending outwardly from the larger notch 46 formed by notches 42 and 44. Knife blade 30*a* is equipped with straight knife edge 48 on the uppermost longitudinal edge thereof and serrated knife edge 50**, located on the lowermost longitudinal edge.

Figure 3:
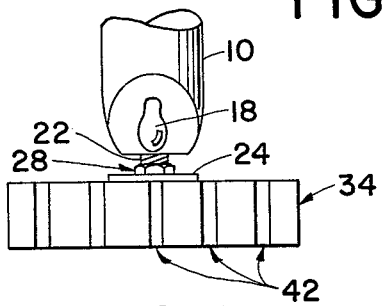
FIG. 3 is a cross-sectional view taken through lines 3—3, viewed in the directions of arrows 3—3 illustrating a plan view of the knife securing bar, shown in FIG. 2, and a portion of the handle and the lamp element secured thereto as shown in FIG. 1.

FIG. 3 illustrates the handle 10 having the light producing portion of lamp 18 protruding therefrom. Threaded rod 22 and its associated nut 28 engage plate 24 secured to bar 34. The openings of notches 42 are illustrated having a rectangular shape extending parallel to the longitudinal axis 52 of the handle 10.

Figure 4:
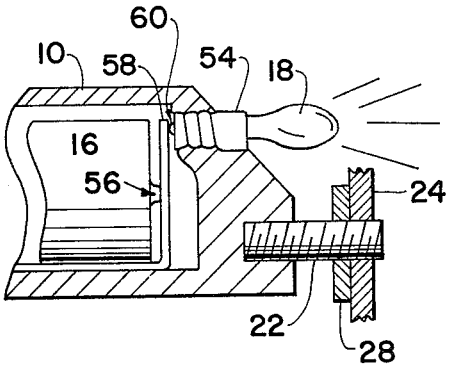
FIG. 4 is a side elevational cross-sectional view of a portion of the handle and lamp element and a portion of the knife securing bar shown in FIG. 3.

FIG. 4 shows housing 10 having a threaded rod 22 emerging outwardly therefrom and providing socket 54 for securing lamp 18 thereto. Battery 16 is illustrated with a positive pole 56 thereof electrically contacting bulb contacting strip 58, which electrically engages a terminal 60 of bulb 18. Nut 28 is shown jambed against plate 24.

Figure 5:
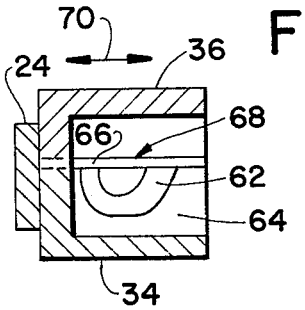
FIG. 5 is a side elevation cross-sectional view taken through lines 5—5, viewed in the direction of arrows 5—5 of the blade securing bar and cover as shown in FIG. 2.

FIG. 5 shows a typical portion of adjacent walls of notches 42 and 44, illustrated in FIG. 2 of cover plate 36 and bar 34. Plate 24 is fixedly secured to bar 34, though in close proximity to the adjacent most proximal surface of cover plate 36. Groove 62 is located in wall 64, a portion of bar 34. The terminal end 66 of groove 62 is located at the juncture of walls 62 and 64. Straight groove 68 enables cover plate 36 to move in the direction of arrows 70 when a projection occupies terminal end 66 of curved groove 62.

Figure 6:
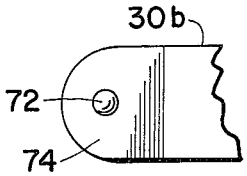
FIG. 6 is a portion of a side elevation view of one of the knife blades shown in FIG. 1.

FIG. 6 wherein knife blade **30*b* is shown with rivet 72 extending outwardly from face 74. In like fashion the other end of rivet 72, not shown, extends outwardly from the rearmost face of the blade, not shown, opposite face 74. These projections are utilized to engage curved groove 62, securing typical knife blade 30*b* within the terminal end 66 of groove 62, as shown in FIG. 5, preventing disengagement of blade 30*b* in the directions of arrow 70**.

One of the advantages of the instant invention is a multi-bladed knife equipped with a battery operated light source facilitating more accurate use of the knife as a cutting instrument.

Another advantage of the instant invention is an apparatus facilitating the mounting of the blades so that either of the cutting edges thereof may be selectively employed when cutting.

Still another advantage of the instant invention is a blade securing bar which enables the user to select amongst discreet locations mounting positions for a quantity of blades.

Yet another advantage of the instant invention is a knife apparatus which is quickly disassembled enabling the user to clean the blade portions and the blade securing bar without wetting or otherwise damaging the handle portion thereof.

And still another advantage of the instant invention is an apparatus which enables the user to conveniently disassemble component parts thereof facilitating a small compact package for storage when not in use.

Thus there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosures herein, but only by the appending claims.

The embodiment of the invention in which an exclusive privilege or property is claimed are defined as follows:

I claim:

1. A multi-bladed knife comprising a handle, light producing means for emanating light beams in the direction of the object to be cut by said knife, fastening means for securing at least one blade to said handle, a plurality of blades, said blades extending parallel to each other in spaced apart relationship and having the longitudinal axes of said blades parallel to the longitudinal axis of said handle when said blades are secured to said handle utilizing said fastening means therefore, said fastening means including a bar threadingly secured to one end of said handle, the longitudinal axis of said bar transverse to said longitudinal axis of said handle, said bar having a cover plate for removable engagement to said bar, said cover plate extending substantially the length of said bar along said longitudinal axis thereof, said bar and said cover plate having co-terminus notches located in spaced apart relationship in the adjacent faces of said bar and said cover plate, said notches having blade securing means for engaging one end of each of said blades to said bar, said cover plate capturing said one end of said each of said blades and preventing the inadvertent disengagement of said end of said each of said blades from said bar, each of said notches having a first internal wall, said first wall parallel to said longitudinal axis of said handle.

2. The multi-bladed knife as claimed in claim 1 wherein said light producing means comprises a lamp having a light producing portion thereof extending outwardly from said handle, said handle housing a battery therein, switch means for controlling the energization of said lamp from current supplied from said battery socket means secured to said handle for electrically connecting to the terminals of said lamp.

3. The multi-bladed knife as claimed in claim 1 wherein said blade securing means comprises a groove located in said first wall, said blade having a projection extending outwardly from a lateral surface thereof, said projection located at said one end of said blade, said projection slidingly engaged within said groove when said blade is secured within one of said notches located within said bar, said notches having a second wall extending perpendicular to said first wall, said second wall in touching engagement with an edge of said blade limiting the rotation of said longitudinal axis of said blade about said projection thereby.

4. The multi-bladed knife as claimed in claim 1 wherein said one blade has a serrated knife like edge extending along one edge of said one blade.

5. The multi-bladed knife as claimed in claim 1 wherein said one blade has a non-serrated knife like edge extending along one edge of said one blade.

6. The multi-bladed knife as claimed in claim 4 further comprising a non-serrated knife like edge extending along the other edge of said one blade.

7. The multi-bladed knife as claimed in claim 1 further comprising said fastening means for threadingly fastening said bar to said handle, said handle having a threaded rod extending outwardly from said one end of said handle, said threaded rod extending along the longitudinal axis of said handle and threadingly engaging an internally threaded hole in said bar, the longitudinal axis of said bar perpendicular to said longitudinal axis of said threaded rod, a cover plate for engagement with said bar, said cover plate extending substantially along the entire length of said bar, a plurality of notches in said bar located in spaced apart relationship having a groove located in a wall of each of said notches, said wall extending parallel to said longitudinal axis of said handle, each of said blades having a projection extending outwardly from a lateral face thereof located adjacent one end of said each of said blades, said cover plate in touching engagement with said one end of each of said blades for limiting the rotation of said each of said blades about said projection when said each of said blades is secured to said notches, said each of said blades having a knife like edge extending along a free edge thereof parallel to the longitudinal axis of said blade.

8. The multi-bladed knife as claimed in claim 3 wherein said projection comprises a rivet fixedly secured to said blade and projecting outwardly from said lateral surface.

9. The multi-bladed knife as claimed in claim 3 further comprising said projection located at the mid line of said blade extending outwardly from both lateral surfaces of said blade enabling said blade to be secured within said notches with either of the lateral surfaces of said blade in touching engagement with said first wall.

* * * * *